United States Patent [19]

Orals et al.

[11] 4,266,384

[45] May 12, 1981

[54] FIRE RESISTANT CEILING FURRING SYSTEM

[75] Inventors: David L. Orals, Arlington Heights; James D. Laffoon, Des Plaines, both of Ill.

[73] Assignee: United States Gypsum Company, Chicago, Ill.

[21] Appl. No.: 51,314

[22] Filed: Jun. 22, 1979

[51] Int. Cl.[3] ..... E04B 1/76; E04B 1/38

[52] U.S. Cl. ..... 52/410; 52/404; 52/407; 52/488; 52/665; 52/714

[58] Field of Search ..... 52/404, 407, 410, 348–350, 52/665, 714, 715, 484, 488, 364

[56] References Cited

U.S. PATENT DOCUMENTS

| | | | |
|---|---|---|---|
| 459,051 | 9/1891 | Streeter | 52/714 X |
| 1,535,504 | 4/1925 | Stephens | 52/364 X |
| 1,786,751 | 12/1930 | Heeren | 52/350 X |
| 2,448,109 | 8/1948 | Michael | 52/364 |
| 3,058,172 | 10/1962 | Phillips | 52/484 X |
| 3,204,383 | 9/1965 | Adams | 52/488 X |
| 3,220,915 | 11/1965 | Shannon | 52/484 X |
| 3,248,257 | 4/1966 | Cadotte et al. | 52/485 X |
| 3,295,267 | 1/1967 | Lundell | 52/488 X |
| 3,998,020 | 12/1976 | Kuhr | 52/484 |

FOREIGN PATENT DOCUMENTS

| | | | |
|---|---|---|---|
| 2220645 | 10/1974 | France | 52/714 |
| 573107 | 11/1945 | United Kingdom | 52/484 |

*Primary Examiner*—Alfred C. Perham
*Attorney, Agent, or Firm*—Robert H. Robinson; Kenneth E. Roberts

[57] ABSTRACT

A fire resistant ceiling furring system comprising support joists in generally parallel alignment, furring clips attaching furring channels to the joists, furring channels in generally parallel alignment at substantially right angles to said joists thereby forming a generally grid-like configuration, said furring channels connected at grid intersection points to said joists by means of said furring clips, fire resistant gypsum ceiling panels affixed at lower attachment surfaces of said furring channels, and, mineral fiber insulation provided for substantially the full expanse of the ceiling being disposed above, and supported by, said furring channels forming a continuous layer beneath said joists. Whereby upon exposure of the fire resistant ceiling furring system to heat from below the furring channels continue to support the mineral fiber insulation and remain engaged to said ceiling panels during heat distortion by means of said furring clips retaining the furring channels. The fire resistant ceiling panels are held in place and retard cracking and contraction from said heat. Said mineral fiber insulation reduces heat transmission to said joists thereby retarding harmful distortion to said joists to inhibit flame spread and heat damage to upper building portions above said fire resistant ceiling furring system.

30 Claims, 7 Drawing Figures

FIRE RESISTANT CEILING FURRING SYSTEM

BACKGROUND OF THE INVENTION (1) Field of the Invention

The invention relates to a fire resistant ceiling furring system that provides a fire rated system by continuing to support mineral fiber insulation between furring channels and joists during heat distortion and further utilizes fire resistant ceiling panels which retard cracking and contraction from said heat, whereby said fire resistant ceiling furring system reduces heat transmission to said joists to retard harmful distortion to said joists and inhibit flame spread and heat damage to upper building portions.

(2) Description of the Prior Art

Previous ceiling systems utilizing furring members for support of ceiling panels encounter the problem of concentrated heat in the board, which results in early fall-off. When such systems provide insulative material above said panels, problems have been encountered supporting the insulation. When the ceiling panels spall, crack, and contract from extreme heat, the panels disengage from the furring channels and drop the insulation material, thereby exposing upper support members to heat and flame during the early stages of a conflagration. This is clearly undesirable in that the containment of a fire to a particular floor, or room, would not take place, and heat damage and flame spread to upper building portions would quickly ensue.

Various prior ceiling systems have attempted to solve the problem of rapid heat damage to upper support joists by utilizing complex runner shapes and numerous clip components for sustaining insulative material. Such systems become cumbersome to install and require additional manufacturing steps, which increase costs accordingly. Other problems encountered involve the continuing engagement of clip members with furring members such that even upon the disengagement of ceiling panels, the clips maintain support of the furring members. Problems have also been encountered in separating the upper support members from the furring members such that heat transmission is reduced. It has been desirable to provide interconnective artifices located at relatively infrequent locations such that paths for heat transmission are reduced, while at the same time separating upper support members from ceiling panels and maintaining engagement of furring members to attain desirable one-hour and two-hour fire rated systems.

It would be highly desirable to insulate upper support members from ceiling panels below to effectuate heat insulation. However, it is concomitantly desirable to attain these goals by utilizing relatively inexpensive members facilitating simple installation procedures. It would accordingly be desirable to provide separate insulation material support separate from support for ceiling panels in which the furring members are utilized and are retained in place by interconnective members supported by the upper support members.

(3) Object of the Invention

It is a primary object of this invention to provide a fire resistant ceiling furring system that continues support for furring members and insulation material during exposure to extreme heat from below.

It is an important object of this invention to insulate and protect upper support joist members from heat damage and retard flame and heat spread to upper building portions.

It is accordingly an object of this invention to permit heat distortion of furring members while yet maintaining supportive engagement with furring clips interconnecting furring members with upper support joists.

An attendant object of this invention is to provide a continuous insulative layer between ceiling panels and upper support joists which remains in place after cracking, spalling, and disengagement of ceiling panels during early stages of exposure to extreme heat from below.

SUMMARY OF THE INVENTION

The present invention attains all of the foregoing objects by providing a fire resistant ceiling furring system that comprises: support joists in generally parallel alignment having a bottom surface and a side surface; furring clips attaching furring channels to the joists, said clips having a flat body portion with upper joist engageable means fastened to said joists and lower furring channel engageable means, said upper engageable means comprising at least one tab portion extending from an upper edge of said body portion and said lower engageable means comprising a flange extending at generally right angles from said body portion, said flange having end folds at opposite ends thereof, said end folds rebent under said flange to opposingly face and create opposing slots engaging flanges of a furring channel; furring channels in generally parallel alignment at substantially right angles to said joists thereby forming a generally grid-like configuration, said furring channels connected at grid intersection points to said joists by means of said furring clips wherein said furring channels have a lower attachment surface and upper sideward extending flanges engaged by the slots of said furring clips for supportive engagement and wherein at least one flange is screw-attached to the furring clips; fire resistant gypsum ceiling panels affixed to the lower attachment surfaces of said furring channels by mechanical fastener means; and, mineral fiber insulation provided for substantially the full expanse of the ceiling and being disposed above, and supported by, said furring channels forming a continuous layer beneath said joists and having a thickness no greater than the depth of the furring clip body portion. Upon exposure to heat from below, furring channels continue to support the mineral fiber insulation and remain engaged to said ceiling panels during heat distortion by means of said furring clips retaining the sideward extending flanges of the furring channels. The fire resistant ceiling panels are held in place and retard cracking and contraction from said heat, and whereby said mineral fiber insulation reduces heat transmission to said joists thereby retarding harmful distortion to said joists to inhibit flame spread and heat damage to upper building portions above said fire resistant ceiling furring system.

The instant invention additionally attains the objects as set forth and provides a fire resistant ceiling furring system comprising: support joists in generally parallel alignment having a bottom attachment surface; a base layer of fire resistant ceiling panels affixed to said bottom attachment surfaces of said joists by mechanical fastening means; furring clips attaching furring channels, said clips having a flat body portion with upper engageable means attached to the joists by mechanical fasteners extending through said base layer to engage said bottom attachment surface of the joists and lower engageable means, said upper engageable means comprising at least one tab portion extending from an upper edge of said body portion and said lower engageable means comprising a flange extending at generally right angles from said body portion, said flange having end folds at opposite ends thereof, said end folds rebent under said flange to opposingly face and create opposing slots engaging flanges of a furring channel; furring channels in generally parallel alignment at substantially right angles to said joists thereby forming a genrally grid-like configuration, said furring channels connected at grid intersection points to said joists by means of said furring clips wherein said furring channels have a lower attachment surface and upper sideward extending flanges engaged by the slots of said furring clips for supportive engagement and wherein at least one flange is screw-attached to the furring clip; a face layer of fire resistant gypsum ceiling panels affixed to the lower attachment surfaces of said furring channels by mechanical fastener means; and, mineral fiber insulation provided for substantially the full expanse of the ceiling and being disposed above, and supported by, said furring channels forming a continuous layer beneath said base layer and having a thickness no greater than the depth of the furring clip body portion. Upon exposure to heat from below the furring channels continue to support the mineral fiber insulation and remain engaged to the face layer of fire resistant gypsum ceiling panels during heat distortion by means of said furring clips retaining the sideward extending flanges of the furring channels. The face layer of fire resistant ceiling panels is held in place and retards cracking and contraction from said heat. The mineral fiber insulation and base layer of fire resistant ceiling panels reduce heat transmission to said joists thereby retarding harmful distortion of said joists and inhibiting flame spread and heat damage to upper building portions.

In satisfying all the objects of the invention as set forth, the present invention provides a furring clip for attachment of furring channels to upper support joists and the like in a ceiling system having fire resistant gypsum ceiling panels attached to said furring channels wherein mineral fiber insulation is supportively disposed on said furring channels below said joists. The novel furring clip of this invention comprises: integral one-piece construction of light-gauge sheet steel having a thickness of from about 0.021 inches to about 0.036 inches; a generally flat body portion with upper joist engageable means and lower furring channel engageable means, said upper engageable means comprising at least one tab portion extending at generally right angles from said body portion and having a pre-cut hole therethrough facilitating mechanical fastener passage therethrough for attachment with joists, said lower engageable means comprising a flange extending at generally right angles from said body portion and having opposite ends, end folds at said opposite flange ends, said end folds being rebent to opposingly face and create opposing slots for flange engagement with furring channels, pre-cut holes through at least one end fold and corresponding flange end facilitating mechanical fastener passage therethrough for attachment with said furring channel flanges. The furring clip is adapted to continue supportive engagement with furring channels during harmful distortion upon exposure to heat from below and provide a separation of ceiling panels from upper support joists, and the like, permitting placement of mineral fiber insulation between furring channels and said upper support joists and the like whereby heat transmission and flame spread is reduced to building areas above and harmful deformation to said upper support joists and the like is inhibited.

DESCRIPTION OF THE PREFERRED EMBODIMENT

Figure 1:
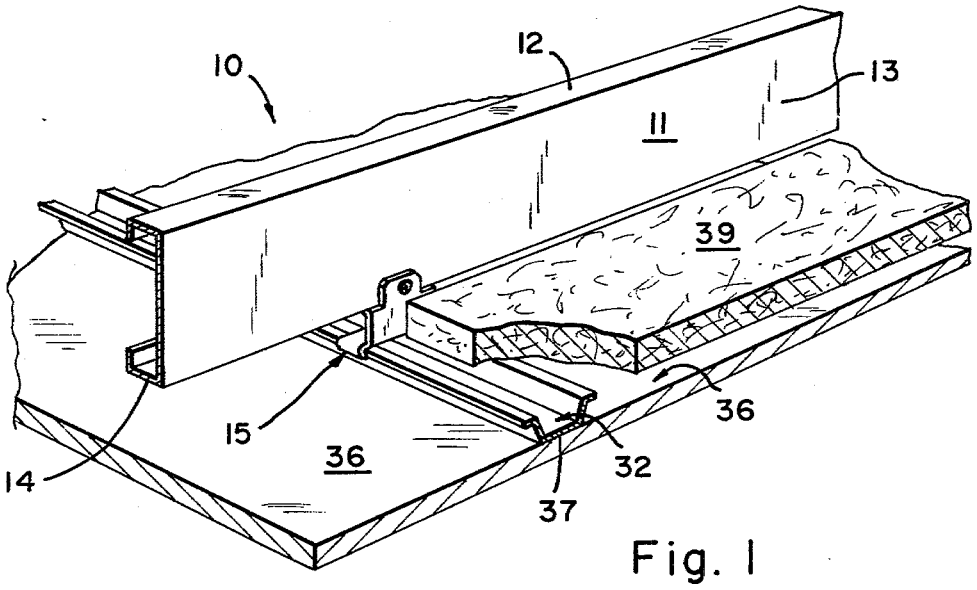
FIG. 1 is a partially broken away perspective view looking down at a portion of the fire resistant ceiling furring system in accordance with the preferred embodiment of this invention.

FIG. 1 illustrates the installed configuration for ceiling furring system 10. Joist 11 is engaged by clip 15, which supports, and interconnects, furring channel 32. Furring channel 32 supports a face layer of gypsum ceiling panels 36. Gypsum ceiling panels 36 provide the ceiling surface for a room below. Joist 11 has a top surface 12, side surface 13, and bottom surface 14. In conventional construction, top surface 12 would be supported below a sub-floor for upper building portions. Such upper sub-floor is typically provided as being a plywood layer. However, it is also envisioned that joist 11 may be otherwise provided in a different structural configuration such as being part of an overall roof truss framework or the like. In all of the normal manners in which joist 11 may be supported from above, it is the satisfied goal of this invention to retard flame spread and heat transmission to protect joist 11 from harmful deformation and reduce heat damage thereby above.

Figure 2:
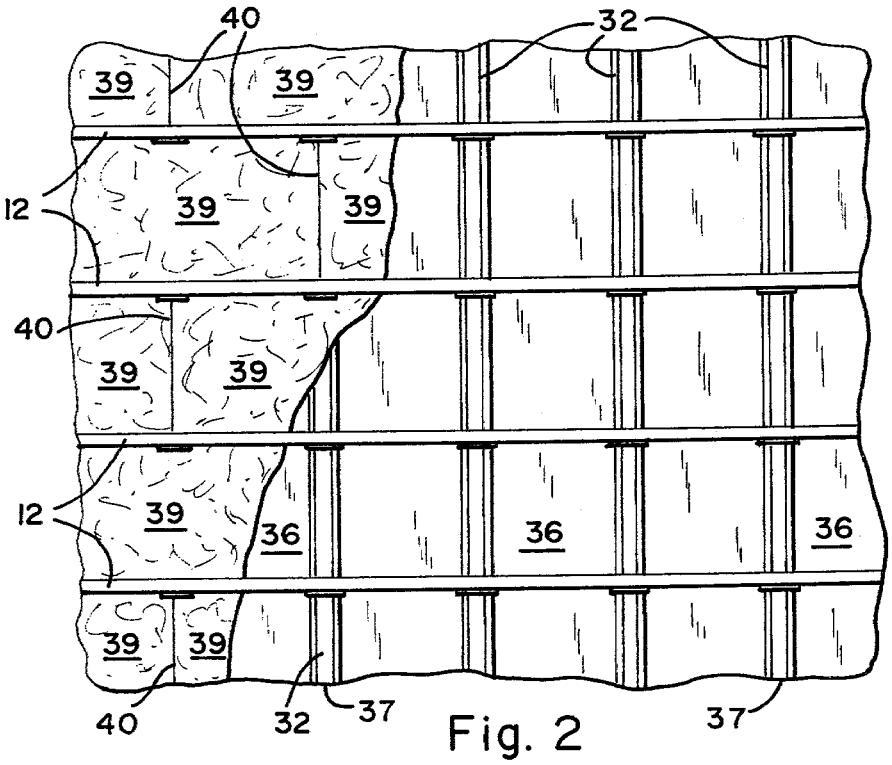
FIG. 2 is a plan view, partially broken away, of a portion of the fire resistant ceiling furring system as shown in FIG. 1.

Turning now to FIG. 2, the ceiling furring system 10 of FIG. 1 is shown in plan view looking downward. The left portion of this figure shows the installed configuration for mineral fiber insulation 39, and the right-hand portion of the figure illustrates ceiling furring system 10 with mineral fiber insulation 39 removed, to expose gypsum ceiling panels 36. Ceiling furring system 10 envisions the utilization of conventional joist spacing and FIG. 2 provides joists 11 at spacings of sixteen inches center-to-center. However, within typical construction modes, the spacing of joists 11 may range from twelve inches to forty-eight inches center-to-center. Accordingly, conventional spacing for furring members is envisioned and furring channels 32 are provided as being spaced apart at sixteen inches center-to-center. Joists 11 are in generally parallel alignment and furring channels 32 are disposed at right angles to joists 11 and are themselves in generally parallel alignment. This configuration provides a generally grid-like appearance from above. The furring channels 32 therefore cross underneath joists 11 every sixteen inches. It is desirable that clips 15 be provided at each of these crossings, or intersection points, for supportive engagement therebetween. Mineral fiber insulation 39 is preferably provided in square or rectangular batts. The batts are envisioned as abutting one another and extending for substantially the full expanse of ceiling furring system 10. Thereby, a continuous insulative layer is provided below joists 11. FIG. 2 illustrates mineral fiber insulation 39 in batts having a width of sixteen inches and a length of four feet. However, other well-known batt sizes for mineral fiber insulation materials may be utilized in accordance with this invention. Such insulation may be field cut or otherwise altered to provide a continuous layer. As later described, the thickness of mineral fiber insulation 39 may be in the range of from about one inch to about six inches. It is envisioned that mineral fiber insulation 39 be provided in a thickness which allows the batts to be laid on furring channels 32 and extend upward but not exeeding the level of bottom surface 14 of joists 11.

The exposed face layer being gypsum ceiling panels 36 is shown at the right-hand side of FIG. 2. The gypsum ceiling panels 36 are preferably provided in widths of about four feet and lengths of about eight feet. Joints 37 are therefore shown as occurring every four feet and are located beneath and along furring channels 32 such that adjacent panels may each be affixed to furring channels 32 at either side of the joint. Other dimensions for gypsum ceiling panels 38 are envisioned within the scope of this invention and typically may range in widths of from about one foot to about six feet and in lengths of from about four feet to about ten feet. In the preferred embodiment, gypsum ceiling panels 36 provide fire resistancy. This fire resistancy is obtained by the addition of additives to the gypsum during manufacture. It is envisioned that the ceiling furring system 10 in accordance with this invention utilize a fire resistant plaster product as disclosed in U.S. Pat. No. 3,454,456, issued July 8, 1969. The addition of vermiculite and glass fiber to the gypsum slurry provides a fire resistant panel that attains a fire rating and that inhibits spalling, cracking, and reduces contraction during exposure to extreme heat. It is therefore particularly functional with the instant invention. However, other gypsum panels which also provide these properties may be equally suitable for use with this invention. The thickness of gypsum ceiling panels 36 may be provided in the range of from about $\frac{3}{8}$ inch to about $1\frac{1}{4}$ inches. It is envisioned in FIG. 2 that gypsum ceiling panels have a thickness of $\frac{5}{8}$ inches.

Figure 3:
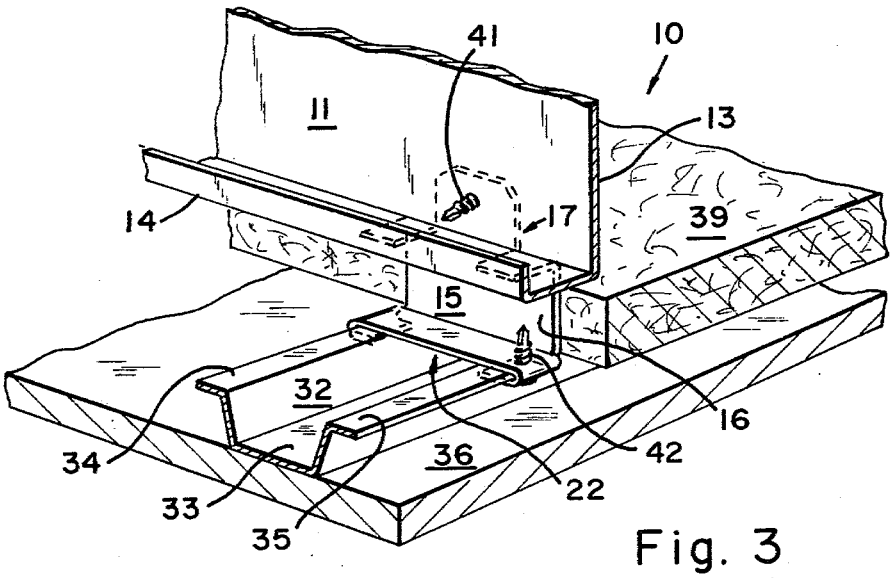
FIG. 3 is a perspective view of a portion of the fire resistant ceiling furring system of FIG. 1 shown in greater detail.

Turning now to FIG. 3, a more detailed view of ceiling furring system 10 is shown. In the preferred embodiment, joist 11 comprises a steel channel having side surface 13 and bottom surface 14. It is equally suitable to utilize wooden joist members having relatively flat side and bottom surfaces for clip 15 attachment. In this embodiment, clip 15 comprises a flat body 16 having a depth of one inch. The depth of flat body 16 may be provided in a range of from about one inch to about six inches in accordance with this invention. The depth of flat body 16 corresponds in the preferred embodiment to the thickness of mineral fiber insulation 39 such that mineral fiber insulation 39 extends from furring channel 32 upward to bottom surface 14 of joist 11 in a continuous layer therebetween. Clip 15 attaches to joist 11 at upper engageable means 17. Clip 15 supports furring channel 32 at lower engageable means 22. Lower engageable means 22 is additionally engaged by screw fastener 42 to furring channel 32, and upper engageable means 17 engages joist 11 by means of screw fastener 41. When a wooden joist is utilized mechanical fastening at upper engageable means 17 may be accomplished by nails, spikes, and the like, as well as screw fasteners. Screw fasteners 41 and 42 are preferably provided as being self-drilling screws well known to the construction industry. Furring channel 32 comprises a lower attachment surface 33 for affixation of gypsum ceiling panels 36. Furring channel 32 additionally comprises upper sideward extending flange 34 and upper sideward extending flange 35 which extend in opposite directions generally in parallel planar relationship with gypsum ceiling panels 36. In the preferred embodiment at least one sideward extending flange, being upper sideward extending flange 35, mechanically fastens with lower engageable means by a screw fastener 42 therethrough. Such mechanical fastening allows clip 15 to distort upon exposure to heat but yet retain furring channel 32 in place.

When subjected to the American Society of Testing and Materials Test Number E 119-76 time and temperature conditions, ceiling furring system 10 as shown in FIG. 3 attained a one-hour fire rating utilizing said gypsum ceiling panels 36 having a thickness of $\frac{5}{8}$ inches. Gypsum ceiling panel 36, having the fire resistant additives as mentioned, reduced spalling, cracking, and contraction during the early stages of the testing procedure. Even upon disengagement of a gypsum ceiling panel 36 from furring channels 32 during such testing, furring channels 32 remained attached to clip 15 thereby maintaining mineral fiber insulation 39 in continuing supportive engagement. Flame spread and heat transmission were thereby reduced and joist 11 was protected. Thereby, upper building portions above joist 11 were additionally protected in pursuance of the goals of this invention and in attainment of desirable fire ratings.

Figure 4:
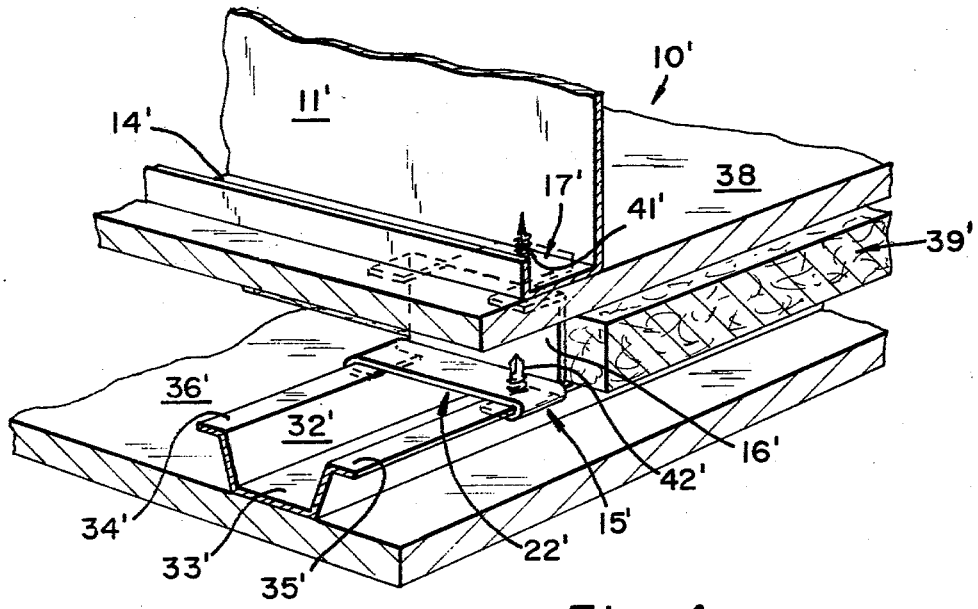
FIG. 4 is a perspective view of the fire resistant ceiling furring system in accordance with this invention utilizing a base layer of ceiling panels affixed to joists.

FIG. 4 provides ceiling furring system 10' in an alternate embodiment for this invention. In this alternate embodiment, an additional base layer of gypsum ceiling panels 38 are provided attached to bottom surface of joists 11'. Clip 15' is provided in an alternate preferred embodiment facilitating affixations through gypsum ceiling panel 38 for connection with bottom surface 14' utilizing screw fasteners 41' therethrough. In the preferred embodiment gypsum ceiling panels 38 are provided in a thickness of $\frac{5}{8}$ inches and have the fire resistant properties as described for gypsum ceiling panels 36. Accordingly, gypsum ceiling panels 36' are substantially identical to gypsum ceiling panels 36 utilizing said fire resistant qualities. Furring channels 32' provide substantially the identical configuration for furring channel 32 utilizing lower attachment surface 33', upper sideward extending flange 34', and upper sideward extending flange 35'. Additionally, mineral fiber insulation 39' is provided in a thickness of about one inch. In this preferred form, when subjected to the time and temperature conditions of American Society of Testing and Materials Test Number E 119-76, ceiling furring system 10' attained a two-hour fire rating. Fire resistancy is provided within the scope of this invention when utilizing other ranges of panel thicknesses and gypsum ceiling panel 36' and gypsum ceiling panel 38 may be provided in a range of thicknesses of from about $\frac{3}{8}$ inch to about $1\frac{1}{4}$ inches and additionally need not be of the same thickness. Moreover, mineral fiber insulation 39' may be provided in a thickness in a range of from about one inch to about six inches. In this alternate preferred embodiment, ceiling furring system 10', gypsum ceiling panels 38 comprising the base layer, provide enhanced flame spread retardancy and inhibition of heat transmission to joists 11'. Clip 15', as with clip 15, is provided to accommodate heat distortion upon exposure to flames, or the like, and yet retain furring channel 32' in place for supportive engagement of mineral fiber insulation 38'. In both ceiling furring systems 10 and 10', clip 15–15' is preferably envisioned as comprising light-gauge sheet steel having a thickness of from about 0.021 inches, 28 gauge, to about 0.036 inches, 20 gauge. Such thickness, being relatively thin, allows for the accommodation of distortion due to heat while having the critical property of retaining furring channel 32 and 32' in place.

Figure 5:
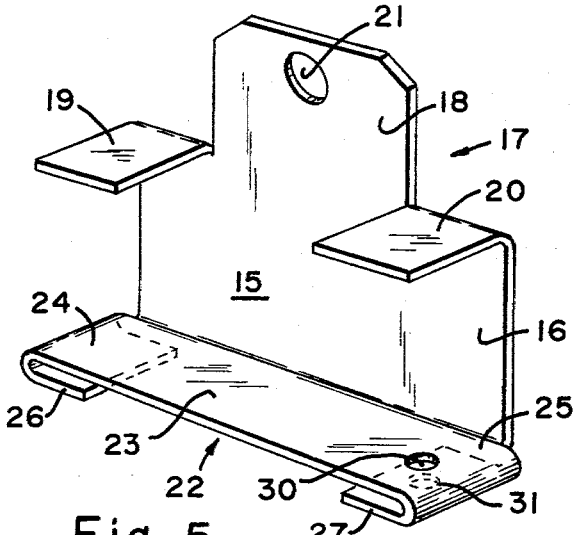
FIG. 5 is a perspective view of the preferred embodiment of the furring clip in accordance with this invention.

With reference to FIG. 5, clip 15 is shown in perspective view for utilization in ceiling furring system 10. In this configuration clip 15 has flat body 16 having upper engagable means 17. Upper engagable means 17 comprise a central tab 18 extending upward from flat body 16 in generally co-planar relationship thereto. At either side of central tab 18 is located adjacent tab 19 and adjacent tab 20, which extend in substantially the same direction at generally right angles to flat body 16 and central tab 18. Central tab 18 is provided with a pre-cut hole 21 facilitating mechanical fastener extension therethrough for affixation with joist 11 at side surface 13. Said mechanical fastener is preferably envisioned as being aforementioned screw fastener 41. In utilizing this embodiment for clip 15, a base layer of ceiling panels is not envisioned and central tab 18 directly contacts side surface 13 of joist 11. Clip 15 additionally comprises lower engagable means 22. Lower engagable means 22 comprises flange 23 extending at generally right angles to flat body 16. Flange 23 has opposite end 24 and opposite end 25. Rebent inwardly of clip 15 are end folds 26 and 27 rebent underneath opposite ends 24 and 25 of flange 23. End folds 26 and 27 are slightly separated downwardly from opposite ends 24 and 25 thereby providing slots 28 and 29 respectively therebetween. Slots 28 and 29 have sufficient space to accommodate insertion of upper sideward extending flange 34 and upper sideward extending flange 35 of furring channel 32. In the preferred embodiment at least one end fold and opposite end have juxtaposed pre-cut holes for passage of mechanical fastening means therethrough. In the preferred embodiment, opposite end 25 has pre-cut hole 30 and end fold 27 has respectively pre-cut hole 31 therethrough. Pre-cut hole 30 and pre-cut hole 31 are juxtaposed for passage of screw fastener 42 vertically therethrough with intermediate penetration of upward sideward extending flange 35, as shown in FIGS. 1 and 3. It is within the spirit of this invention that opposite end 24 and respective end fold 26 be additionally provided with pre-cut holes if additional attachment is desired.

Figure 6:
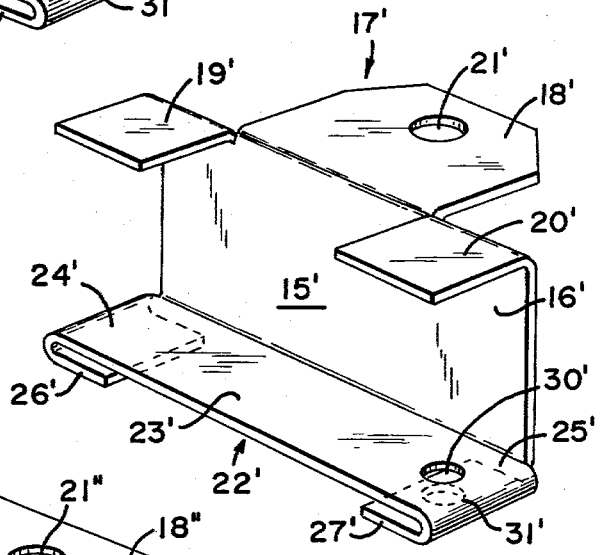
FIG. 6 is a perspective view of an alternate preferred embodiment of the furring clip in accordance with this invention.

Referring now to FIG. 6, the preferred alternative embodiment is shown for clip 15'. Clip 15' is desirably provided when utilizing a base layer of gypsum ceiling panels 38, which are directly affixed to bottom surface 14' of joist 11' as shown in FIG. 4. Clip 15' is substantially identical to clip 15 except that central tab 18' is disposed at generally right angles to flat body 16' rather than extending upwardly generally co-planar as shown for the preferred embodiment of clip 15. This configuration of clip 15' facilitates attachment by screw fasteners 41' passing through gypsum ceiling panels 38 to engage bottom surface 14' of joist 11'. In this alignment central tab 18', adjacent tab 19', and adjacent tab 20' abut gypsum ceiling panels 38 in flush contact. Central tab 18' extends in a direction opposite flange 23' facilitating utilization of a screwdriver, or the like, for affixation of screw fastener 42' from below. Clip 15' is provided in a thickness in the same range as stated for clip 15. Being a light-gauge sheet-steel, distortion is accommodated during exposure to heat and continuing engagement with furring channels 32' is provided to attain fire resistancy for ceiling furring system 10'. It is additionally envisioned within the scope of this invention that clip 15' is alternatively useful for use with ceiling furring system 10 wherein central tab 18' would engage bottom surface 14 of joist 11 rather than side surface 13.

Figure 7:
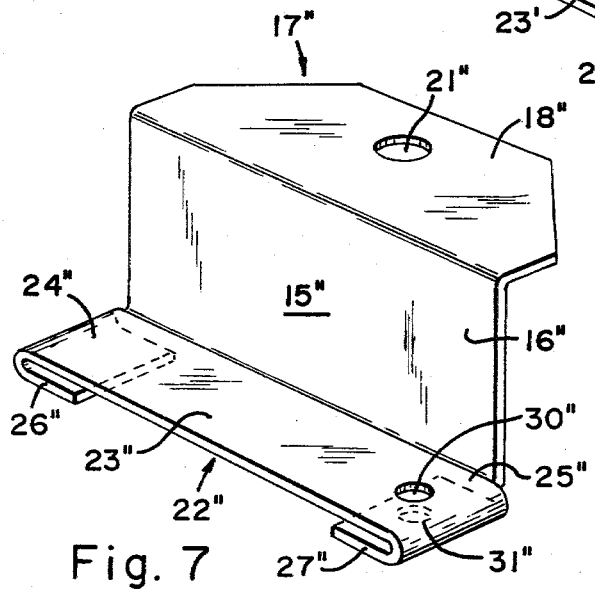
FIG. 7 is a perspective view of an alternate preferred embodiment in accordance with this invention.

FIG. 7 depicts the alternate preferred embodiment for a clip useful with ceiling system 10' and being clip 15''. Clip 15'' is useful for attachment through a base layer of gypsum ceiling panels such as gypsum ceiling panels 38 facilitating passage of fasteners, such as screw fasteners 42–42' therethrough for engagement with bottom surfaces of joists such as bottom surfaces 14 or 14' of joist 11 or 11'. This alternative configuration, clip 15'', is substantially identical to that of clip 15' except that central tab 18'' comprises only one tab with no adjacent tabs and extends for substantially the full width of flat body 16'' at generally right angles thereto in a direction opposite flange 23'' of lower engagable means 22''. Accordingly, a pre-cut hole 21'' is provided facilitating passage of mechanical fasteners therethrough. Pre-cut hole 21'' is generally centrally located in central tab 18''. Clip 15'' is provided likewise in a range of thicknesses as set forth for clips 15 and 15'. Accordingly, clip 15'' may also, within the spirit of this invention, be utilized for attachment of ceiling furring system 10 wherein it would attach to bottom surface 14 rather than side surface 13. With central tab 18'' extending in a direction opposite flange 23'' affixation by means of a screwdriver, or the like, would be attained during installation procedures from below.

In all the alternative preferred embodiments depicted in FIGS. 5–7, it is envisioned that flange 23, 23', and 23'' extend for a distance in a range of from about ½ inch to about 1½ inches from flat body 16, 16', and 16''. It is additionally desirable, that central tab 18, 18', and 18'' extend from flat body 16, 16', and 16'' for a distance in a range from about ½ inch to about 1½ inches. As particular installation requirements dictate, flat body 16, 16', and 16'' may be provided in a depth of from about one inch to about six inches corresponding to the thickness of mineral fiber insulation 39, 39', and 39'' as varying batt thicknesses are utilized. However, flat body 16, 16', and 16'' need not be limited to the batt thickness and may be greater than, but not less than, the batt thickness within the prescribed depth range herein set forth.

It is thus seen that this invention provides continuing support of a mineral fiber insulation layer which extends for substantially the full expanse of the ceiling system. Thus provided, heat transmission to upper building portions is reduced and upper support joists are protected as well.

It is also envisioned within the spirit and scope of this invention to provide additional fire resistancy by laminating the face layer and providing gypsum ceiling panels 36 or 36' in double layers. Thereby, two thicknesses of gypsum ceiling panels may be provided. In this manner, a cumulative thickness at the face layer may be provided in a range of from about ¾ inches to about 2½ inches as particular construction needs arise. It is also envisioned that at each crossing, or intersection point, between joists 11 and furring channels 32 a clip 15 need not be provided but may be provided in a pattern that attains adequate support for ceiling furring system 10. The same being correspondingly true for ceiling furring system 10'. It is also envisioned that combinations and permutations of pre-cut holes in the opposite ends and end folds be utilized wherein some clips may have pre-cut holes at both opposite ends of flanges 23, 23', and 23'', and others provide, as shown in the preferred embodiment, only pre-cut holes at one opposite end and end fold respectively. One skilled in the art would adequately foresee particular construction needs encountered and within the spirit and scope of this invention utilize such construction.

The fire resistant ceiling furring system as herein disclosed thereby provides relatively simple components for reduction of manufacturing costs as well as installation time. Simple procedures for the installation of the invention fire resistant ceiling furring system is thus accomplished. With the only need for the mechanical affixation of screw fasteners the requirement for additional tools is overcome. Therefore all the objects and aims of this invention are accomplished as disclosed.

While only particular forms and embodiments of this invention have been shown and described, others within the spirit and scope of the invention will become apparent to those skilled in the art. Therefore, the embodiments shown in the drawings are to be considered as merely setting forth the invention for illustrative purposes, and are not intended to limit the scope of the invention being described and shown.

What is claimed is:

1. A fire resistant ceiling furring system comprising:

support joists in generally parallel alignment having a bottom surface and a side surface;

furring clips attaching furring channels to the joists, said clips having a flat body portion with upper joist engageable means fastened to said joists and lower furring channel engageable means engaging furring channels, said upper engageable means comprising at least one tab bottom extending from an upper edge of said body portion and said lower engageable means comprising a flange extending at generally righ angles from said body portion, said flange having end folds at opposite ends thereof, said end folds rebent under said flange to opposingly face and create opposing slots engaging flanges of a furring channel;

furring channels in generally parallel alignment at substantially ring angles to said joists thereby forming a generally grid-like configuration, said furring channels connected at grid intersection points to said joists by means of said furring clips wherein said furring channels have a lower attachment surface and upper sideward extending flanges engaged by the slots of said furring clips for supportive engagement and wherein at least one flange is screw-attached to the furring clip;

first resistant gypsum ceiling panels affixed to the lower attachment surfaces of said furring channels by mechanical fastener means; and, mineral fiber insulation provided for substantially the full expance of the ceiling and being disposed above, and supported by, said furring channels forming a continuous layer beneath said joists and having a thickness no greater than the depth of the furring clip body portion;

whereby upon exposure to heat from below the furring channels continue to support the mineral fiber insulation and remain engaged to said ceiling panels during heat distortion by means of said furring clips retaining the sideward extending flanges of the furring channels, wherein the fire resistant ceiling panels are held in place and retard cracking and contraction from said heat, whereby said mineral fiber insulation reduces heat transmission to said joists thereby retarding harmful distortion to said joists to inhibit flame spread and heat damage to upper building portions above said fire resistant ceiling furring system.

2. A fire resistant ceiling furring system as claimed in claim 1 wherein the furring clip comprises light-gauge sheet steel having a thickness of from about 0.021 inches, 28 gauge, to about 0.036 inches, 20 gauge.

3. A fire resistant ceiling furring system as claimed in claim 1 wherein said joists comprise wood.

4. A fire resistant ceiling furring system as claimed in claim 3 wherein said upper engageable means of said furring clips are fastened by nail fasteners to said joists.

5. A fire resistant ceiling furring system as claimed in claim 3 wherein said upper engageable means of said furring clips are fastened by screw fasteners to said joists.

6. A fire resistant ceiling furring system as claimed in claim 1 wherein said joists comprise steel channels.

7. A fire resistant ceiling furring system as claimed in claim 6 wherein said upper engageable means of said furring clips are fastened by screw fasteners to said joists.

8. A fire resistant ceiling furring system as claimed in claim 1 wherein said mineral fiber insulation has a thickness in the range of from about one inch to about six inches.

9. A fire resistant ceiling furring system as claimed in claim 1 wherein said body portion of said furring clip has a depth of from about one inch to about six inches.

10. A fire resistant ceiling furring system as claimed in claim 1 wherein said upper engageable means of said furring clip comprises a central tab and two adjacent tabs wherein said central tab is engaged to said joist and extends at generally right angles to said body portion and said adjacent tabs extend in the opposite direction of said central tab at generally right angles to said body portion, wherein said central tab and adjacent tabs abut the bottom surface of said joist.

11. A fire resistant ceiling furring system as claimed in claim 1 wherein said upper engageable means of said furring clip comprises a central tab extending upwardly from, and generally co-planar with, said body portion, and two adjacent tabs extending in the same direction at generally right angles to said body portion, whereby said central tab is engaged to said side surface of said joist and said adjacent tabs abut the bottom surface of said joists.

12. A fire resistant ceiling furring system as claimed in claim 1 wherein said clip comprises upper engageable means having one tab extending the full width of said body portion at generally right angles thereto, whereby said one tab engages said joint at the bottom surface thereof.

13. A fire resistant ceiling furring system as claimed in claim 1 wherein said fire resistant gypsum ceiling panels are provided in two layers provided a double-layered laminate ceiling surface.

14. A fire resistant ceiling furring system as claimed in claim 1 wherein said fire resistant gypsum ceiling panels have a thickness in the range of from about $\frac{3}{8}$ inch to about $1\frac{1}{4}$ inch.

15. A fire resistant ceiling furring system as claimed in claim 14 wherein said fire resistant gypsum ceiling panels have fire resistant additives comprising vermiculite and glass fiber.

16. A fire resistant ceiling furring system comprising:

support joists in generally parallel alignment having a bottom attachment surface;

a base layer of fire resistant ceiling panels affixed to said bottom attachment surfaces of said joists by mechanical fastening means;

furring clips attaching furring channels, said clips having a flat body portion with upper engageable means attached to the joists by mechanical fasteners extending through said base layer to engage said bottom attachment surface of the joists and lower engageable means, said upper engageable means comprising at least one tab portion extending from an upper edge of said body portion and said lower engageable means comprising a flange extending at generally right angles from said body portion, said flange having end folds at opposite ends thereof, said end folds rebent under said flange to opposingly face and create opposing slots engaging flanges of a furring channel;

furring channels in generally parallel alignment at substantially right angles to said joists thereby forming a generally grid-like configuration, said furring channels connected at grid intersection points to said joists by means of said furring clips wherein said furring channels have a lower attachment surface and upper sideward extending flanges engaged by the slots of said furring clips for supportive engagement and wherein at least one flange is screw-attached to the furring clip;

a face layer of fire resistant gypsum ceiling panels affixed to the lower attachment surfaces of said furring channels by mechanical fastener means; and, mineral fiber insulation provided for substantially the full expance of the ceiling and being disposed above, and supported by, said furring channels forming a continuous layer beneath said base layer and having a thickness no greater than the depth of the furring clip body portion;

whereby upon exposure to heat from below the furring channels continue to support the mineral fiber insulation and remain engaged to the face layer of fire resistant gypsum ceiling panels during heat distortion by means of said furring clips retaining the sideward extending flanges of the furring channels, wherein the face layer of fire resistant gypsum ceiling panels is held in place and retards cracking and contraction from said heat, whereby said mineral fiber insulation and base layer of fire resistant gypsum ceiling panels reduce heat transmission to said joists thereby retarding harmful distortion of said joists and inhibiting flame spread and heat damage to upper building portions above said fire resistant ceiling furring system.

17. A fire resistant ceiling furring system as claimed in claim 16 wherein the furring clips comprise light-gauge sheet steel having a thickness of from about 0.021 inches, 28 gauge, to about 0.036 inches, 20 gauge.

18. A fire resistant ceiling furring system as claimed in claim 16 wherein said joists comprise wood.

19. A fire resistant ceiling furring system as claimed in claim 18 wherein said upper engageable means of said furring clips are fastened by nail fasteners to said joists.

20. A fire resistant ceiling furring system as claimed in claim 18 wherein said upper engageable means of furring clips are fastened by screw fasteners to said joists.

21. A fire resistant ceiling furring system as claimed in claim 16 wherein said joists comprise steel channels.

22. A fire resistant ceiling furring system as claimed in claim 21 wherein said upper engageable means of said furring clips are fastened by screw fasteners to said joists.

23. A fire resistant ceiling furring system as claimed in claim 16 wherein said mineral fiber insulation has a thickness in the range of from about one inch to about six inches.

24. A fire resistant ceiling furring system as claimed in claim 16 wherein said body portion of said furring clip has a depth of from about one inch to about six inches.

25. A fire resistant ceiling furring system as claimed in claim 16 wherein said upper engageable means of said furring clip comprises a central tab and two adjacent tabs wherein said central tab is engaged to said joist by means of mechanical fasteners extending through said base layer to engage said bottom attachment surface of the joists and said central tab extends at generally right angles to said body portion, said adjacent tabs extend in an opposite direction of said central tab at generally right angles to said body portion, wherein said central tab and adjacent tabs abut the base layer of fire resistant ceiling panels.

26. A fire resistant ceiling furring system as claimed in claim 16 wherein said furring clip comprises upper engageable means having one tab extending the full width of said body portion at generally right angles thereto, whereby said one tab engages said joist by means of mechanical fasteners extending through the base layer to engage said bottom attachment surface of the joist and wherein said one tab contacts the base layer of fire resistant gypsum ceiling panels.

27. A fire resistant ceiling furring system as claimed in claim 16 wherein said face layer of fire resistant gypsum ceiling panels are provided in two layers providing a double-layered laminate ceiling surface.

28. A fire resistant ceiling furring system as claimed in claim 16 wherein said fire resistant gypsum ceiling panels have a thickness in the range of from about $\frac{3}{8}$ inch to about $1\frac{1}{4}$ inch.

29. A fire resistant ceiling furring system as claimed in claim 28 wherein said fire resistant gypsum ceiling panels have fire resistant additives comprising vermiculite and glass fiber.

30. A furring clip for attachment of furring channels to upper support joists and the like in a ceiling system having fire resistant gypsum ceiling panels attached to said furring channels wherein mineral fiber insulation is supportively disposed on said furring channels below said joists, said furring clip comprising:

integral one-piece construction of light-gauge sheet steel having a thickness of from about 0.021 inches to about 0.036 inches;

a generally flat body portion with upper joist engageable means and lower furring channel engageable means, said upper engageable means comprising a central tab and two adjacent tabs wherein the central tab has a pre-cut hole facilitating attachment to joists, and the like, extending at generally right angles to the body portion, and said adjacent tabs extending in a direction opposite of said central tab at generally right angles to said body portion wherein said central tab and adjacent tabs are generally co-planar and adapted to abut with a lower planar surface of an upper support joist, and the like, said lower engageable means comprising a flange extending at generally right angles from said body portion and having opposite ends, and folds at said opposite flange ends, said end folds being rebent to opposingly face and create opposing slots for flange engagement with furring channels, pre-cut holes juxtaposed through at least one end fold and corresponding flange end faciliating mechanical fastener passage therethrough for attachment with said furring channel flanges;

whereby said furring clip is adapted to continue supportive engagement with furring channels during harmful distortion upon exposure to heat from below and provide separation of ceiling panels from upper support joists, and the like, permitting placement of mineral fiber insulation between furring channels and said upper support joists, and the like, whereby heat transmission and flame spread is reduced to building areas above and harmful deformation to said support joists and the like, is inhibited.

* * * * *

UNITED STATES PATENT AND TRADEMARK OFFICE

CERTIFICATE OF CORRECTION

PATENT NO. : 4,266,384

DATED : May 12, 1981

INVENTOR(S) : David L. Orals and James D. Laffoon

It is certified that error appears in the above—identified patent and that said Letters Patent is hereby corrected as shown below:

In the Specification:

Column 3, line 10, change "genrally" to --generally--.

Column 5, line 21, change "exeeding" to --exceeding--.

Column 9, line 22, change "invention" to --inventive--.

In the Claims:

Column 9, line 48, change "righ" to --right--.
Column 9, line 54, change "ring" to --right--.
Column 9, line 63, change "first" to --fire--.
Column 9, line 67, change "expance" to --expanse--.

Signed and Sealed this

*Eighteenth* Day of *August 1981*

[SEAL]

*Attest:*

GERALD J. MOSSINGHOFF

*Attesting Officer*

*Commissioner of Patents and Trademarks*